US005826383A

United States Patent [19]

Garrison

[11] Patent Number: 5,826,383

[45] Date of Patent: Oct. 27, 1998

[54] ROOF CLOSURE VENT SYSTEM

[76] Inventor: Charles F. Garrison, P.O. Box 55392
222 Peck Rd., Houston, Tex. 77055

[21] Appl. No.: 777,929

[22] Filed: Dec. 23, 1996

[51] Int. Cl.[6] ..... F24F 7/02

[52] U.S. Cl. ..... 52/198; 454/366; 454/365; 52/94; 52/95; 52/199

[58] Field of Search ..... 52/94, 95, 198, 52/199; 454/365, 366, 367

[56] References Cited

U.S. PATENT DOCUMENTS

| | | | |
|---|---|---|---|
| 27,943 | 3/1860 | Smith . | |
| 2,789,493 | 4/1957 | Riggle . | |
| 2,885,942 | 5/1959 | Hirst . | |
| 3,051,071 | 8/1962 | Leigh . | |
| 3,481,263 | 12/1969 | Belden . | |
| 3,683,785 | 8/1972 | Grange | 52/95 X |
| 4,126,973 | 11/1978 | Luckey . | |
| 4,325,290 | 4/1982 | Wolfert . | |
| 4,545,291 | 10/1985 | Kutsch et al. . | |
| 4,622,887 | 11/1986 | Peterson . | |
| 4,635,419 | 1/1987 | Forrest | 52/302.3 |
| 4,643,080 | 2/1987 | Trostle et al. . | |
| 4,676,145 | 6/1987 | Allred . | |
| 4,676,147 | 6/1987 | Mankowski | 454/365 |
| 4,776,262 | 10/1988 | Curran | 52/95 |
| 4,843,953 | 7/1989 | Sells | 454/366 X |
| 4,876,950 | 10/1989 | Rudeen | 454/365 |
| 4,907,499 | 3/1990 | James . | |
| 4,924,761 | 5/1990 | Macleod et al. | 454/366 X |
| 4,942,699 | 7/1990 | Spinelli | 52/199 X |
| 5,092,225 | 3/1992 | Sells | 52/199 X |
| 5,339,582 | 8/1994 | Sells . | |
| 5,352,154 | 10/1994 | Rotter et al. . | |
| 5,425,672 | 6/1995 | Rotter | 52/199 X |
| 5,427,571 | 6/1995 | Sells | 454/365 |
| 5,473,847 | 12/1995 | Crookston | 52/95 X |
| 5,603,657 | 2/1997 | Sell | 454/365 X |

OTHER PUBLICATIONS

Metallic Products Corporation, Louvers–Ventilators–Trim–Roof Curbs–Specialty Items brochure entitled Roof Curbs.
Metallic Products Corporation brochure on Ridge Ventilator with die—formed side skirt.
Table of Capacities for Continuous Ventilators.
Metallic Products Corporation brochure entitled Low Profile Floating Ridge Vent. . .Ridgeline.

*Primary Examiner*—Wynn E. Wood
*Attorney, Agent, or Firm*—Matthews, Joseph, Shaddox & Mason, L.L.P.

[57] ABSTRACT

A roof ventilation system of the type for venting air from under a roof and preventing water, debris and pests from penetrating the ventilation system and entering the interior of the structure is provided. The roof closure vent system includes: a structure having a sloped metal roof having a ridge slot formed along substantially the length of a roof ridge permitting ventilation from the interior under said roof to the exterior; and a ridge closure vent positioned adjacent each longitudinal side of said ridge slot extending substantially along the length thereof fastened between said roof and a ridge panel, in place of the ridge closure vent or in combination therewith is a eave closure vent connected beneath said roof substantially along the length of an eave of said roof.

28 Claims, 2 Drawing Sheets

ROOF CLOSURE VENT SYSTEM

TECHNICAL FIELD

The present invention relates to devices for roof ventilation and more particularly to devices for roof ventilation that include eave and/or ridge closure vents for providing ventilation of structures having metal roofs.

BACKGROUND ART

It has been a long known practice to ventilate structures having sloped roofs by creating a vent opening along the roof ridge. The vent opening is created during construction by sizing the uppermost row of sheeting panels to leave an open slot running along the ridge extending essentially the length of the roof. The slot permits air to vent from the structure by convection airflow and by suction from wind blowing across the roof. Maximum air flow from under the roof would occur if the ridge slot were left uncovered, however, the need to keep water, dirt and pests out of the structure requires a covering over the slot. Commonly, in metal roof installations, a ridge panel or cap is connected to the top row of roof panels atop the ridge slot with a closure strip or mastic disposed between the ridge panel and the roof panels. This manner of covering the ridge slot prevents the desired ventilation from under the roof. It is also known for ventilators to be installed atop the ridge slot, however, these prior art ventilators require additional installation, man hours and increase the expense of constructing a metal roof.

In many structures having non-metal roofs soffit ventilators are frequently used in conjunction with the ridge vent to provide passive ventilation. The soffit vents allow fresh ambient air to flow into the attic to equalize attic temperature and pressure with the outside. As stale hot air is withdrawn from the ridge slot vent by convection and/or wind suction, it is replaced by fresh ambient air entering the attic through the soffit vents.

Commonly, in metal roof structures there is not a soffit to install vents. In metal roof installations the roof panels are connected to the eave strut with a closure strip disposed therebetween. This manner of installing the roof panels prevents passive ventilation to aid in ventilation through the roof ridge.

It would be a benefit, therefor, to have a metal roof ventilation system which permits ventilation along the ridge and/or passive ventilation along the eave line. It would be a further benefit to have a ridge closure vent and an eave closure vent which permits the roof panels and ridge panel to be securely attached to the structure while allowing ventilation from beneath the roof. It would be a still further benefit to have a ventilation system which has layered closure vents which prevent water, debris and pests from penetrating the closure vents. It would be a still further benefit, to have a metal roof ventilation system which does not require additional labor, equipment or accessories from the conventional metal roof installations.

GENERAL SUMMARY DISCUSSION OF INVENTION

It is thus an object of the invention to provide a roof closure vent system that has a ridge closure vent and/or an eave closure vent.

It is a further object of the invention to provide a roof closure vent system that has layered closure vents which provide ventilation without permitting the penetration of water, debris and pest therethrough.

It is a still further object of the invention to provide a roof closure vent system that permits ventilation without compromising the secure installation of the roof panels and the ridge panel.

It is a still further object of the invention to provide a roof closure vent system that does not require any additional labor, equipment or accessories from conventional metal roof installations.

Accordingly, a roof ventilation system of the type for venting air from under a roof and preventing water, debris and pests from penetrating the ventilation system and entering the interior of the structure is provided. The roof closure vent system includes: a structure having a sloped metal roof having a ridge slot formed along substantially the length of a roof ridge permitting ventilation from the interior under said roof to the exterior; and a ridge closure vent positioned adjacent each longitudinal side of said ridge slot extending substantially along the length thereof fastened between said roof and a ridge panel, in place of the ridge closure vent or in combination therewith is a eave closure vent connected beneath said roof substantially along the length of an eave of said roof.

In a preferred embodiment of the roof closure vent system, ridge closure vents are positioned adjacent each longitudinal side of the ridge slot or opening. The ridge closure vent includes a first closure member having perforations formed laterally therethrough for air to pass, exiting the interior of the structure. This first closure member faces the exterior of the structure. Connected to the interior side of the first closure member is a mesh mat. The mesh mat covers the perforations deterring the entry of water, debris and pests into the interior of the structure. The ridge closure vent is constructed so that its profile matches the contour of the roof panels and ridge panel that it is connected between. The first closure member may also include weep holes along its bottom surface to allow water which may condense interior of the closure vent or in the mesh mat to drain.

The ridge closure vent may include additional closure members each having perforations formed laterally therethrough. In this embodiment of the system each closure member is spaced from the adjacent closure member by a layer of mesh mat. The closure members and mesh mat may be interconnected by bonding or the like to form a unitary closure vent or the members and mat may be positioned adjacent to one another. In this embodiment the perforations of adjacent closure members may be aligned with or offset from one another. Preferably, the perforations are offset to further aid in deterring penetration of water and the like. It is also desirable to attach an adhesive on portions of the bottom surface of at least one of the closure members to secure the ridge closure vent to the roof before installing the ridge panel. Preferably, an adhesive strip is connected to a bottom surface of an interior closure member for ease in installation of the ridge closure vent. The closure members may include weep holds along the bottom surface to allow condensation to drain.

In another preferred embodiment of the roof closure vent system, eave vent closures are fastened under the roof between the roof panels and the eave struts. The eave closure vent includes a first closure member having perforations formed laterally therethrough. The first closure member faces the exterior of the structure and a mesh mat is connected along the interior surface of the closure member. The eave closure vent may further include at least a second closure member spaced from the first and connected therewith by another mesh mat. The second closure member further includes lateral perforations therethrough which may be aligned with or offset from the perforations of the adjacent closure member. Preferably, the perforations of adjacent closure members are offset to further block water and the like which may pass through the mesh mat. It is also desirable to have weep holes formed along the bottom surface of the exterior most closure member to allow any condensation to drain. In addition, the interior closure members may have weep holes formed along their bottom surface. It is further desirable to have an adhesive on a bottom surface of at least one of the closure members to aid in installation of the eave closure vent.

Preferably, the eave closure vent is used in conjunction with the ridge closure vent of the present invention to provide passive ventilation of the structure. However, the eave closure vent may be used alone or in conjunction with other types of roof ventilators.

In the most preferred embodiment, the roof closure vent system includes a ridge closure vent and eave closure vents. In this embodiment each of the closure vents includes at least one closure member and one mesh mat connected thereto. The closure vents may include additional closure members to provide further strength to the roof and to further deter penetration of water, debris and pests.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
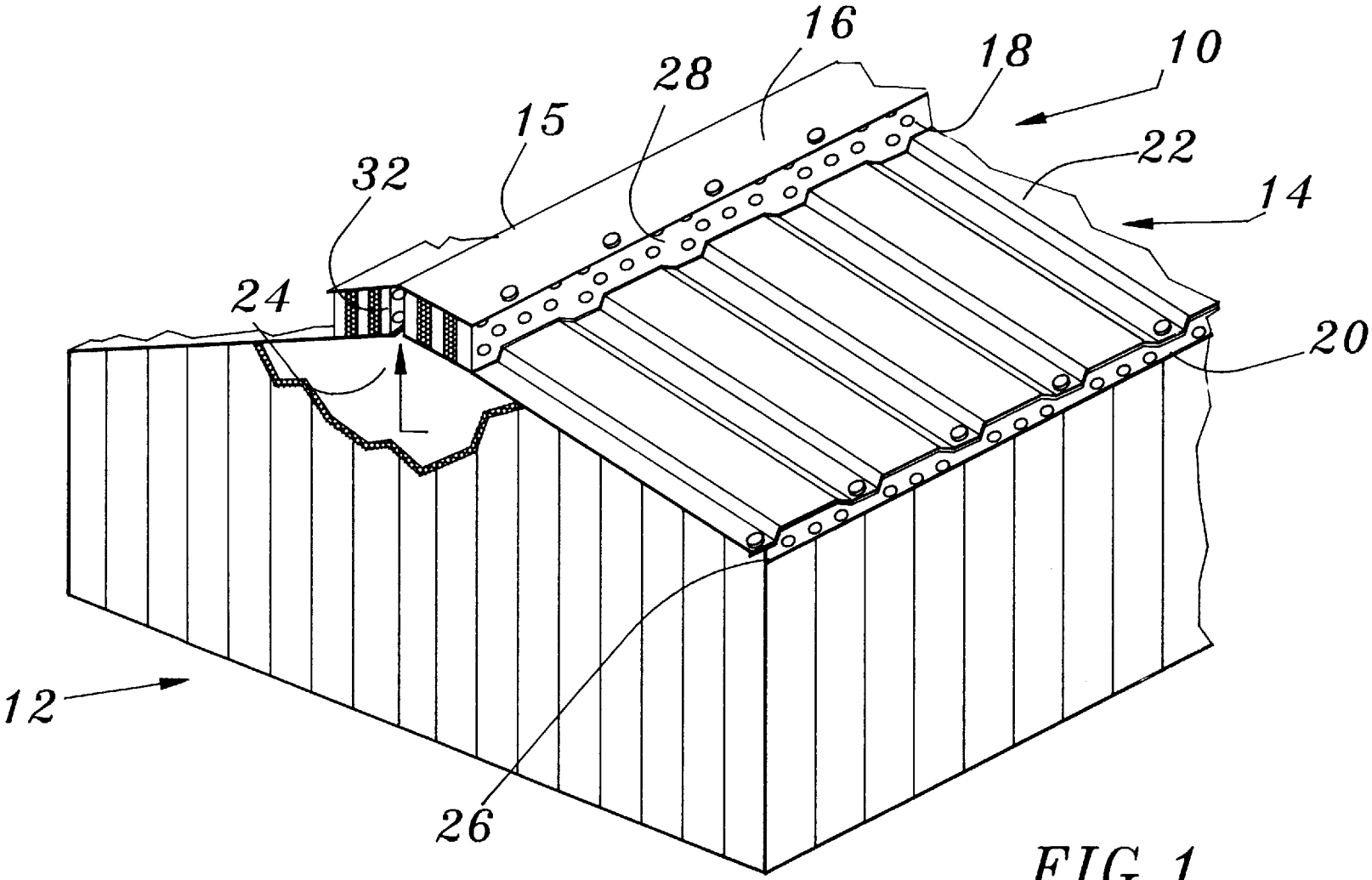
FIG. 1 is a partial, sectional perspective view of an exemplary embodiment of the roof closure vent system of the present invention.

FIG. 1 is a partial, sectional perspective view of an exemplary embodiment of the roof closure vent system of the present invention generally designated by the numeral 10. Closure vent system 10 includes a structure 12 having a metal roof 14, a ridge panel 16, a ridge closure vent 18 and an eave closure vent 20.

Building 12 may be any type of structure having metal roof 14. Metal roof 14 is constructed of roof panels 22 fastened to the eave struts and purlins (not shown) in any manner well known in the art such as with screws. As shown in this embodiment, roof panels 22 are corrugated panels, however, this invention is equally applicable to other panel types such as standing seam panels. Roof panels 22 of the opposing sides of roof 14 terminate approximate the ridge 15 of roof 14 to define an open ridge slot 24 along the length of the roof's ridge 15 permitting ventilation from the interior under roof 14.

Ridge closure vents 18 are positioned adjacent each longitudinal side of ridge slot 24 extending substantially along the length of slot 24 and fastened between ridge panel 16 and roof 14. Ridge panel 16 is connected atop ridge closure vents 18 and securely attached with screws to prevent rain and other debris from entering through ridge slot 24. In this manner air vents from under roof 14 through ridge closure vent 18 to the exterior as shown by the arrows.

Eave closure vents 20 are provided to aid in ventilation through ridge closure vents 18. Eave closure vents 20 are connected between the eave struts (not shown) and roof 14 along the horizontal eave 26 of roof 14. Eave closure vent 20 permits air to flow therethrough under roof 14 to aid in ventilation through ridge closure vent 18.

Figure 2:
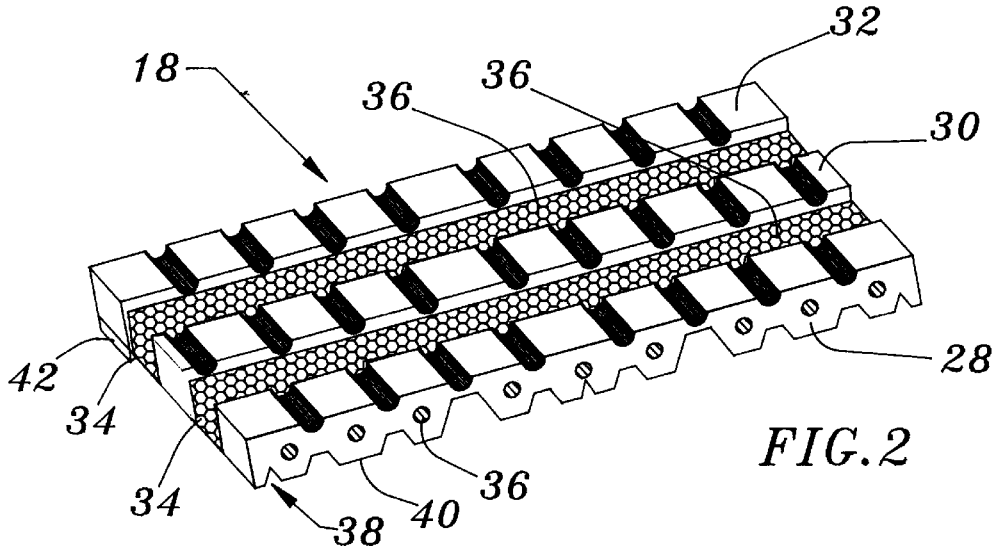
FIG. 2 is a perspective view of a section of the ridge closure vent.

FIG. 2 is a perspective view of a section of ridge closure vent 18. Ridge closure vent 18 is constructed of a first closure member 28, a second closure member 30, a third closure member 32 and a mesh mat 34 interconnected by bonding to form a unitary structure. It is not required that closure vent 18 be constructed as a unitary structure, in the alternative closure members 28, 30, 32 and mesh mat 34 may be positioned adjacent to one another in a layered fashion.

Closure members 28, 30, 32 of this embodiment are constructed of a crosslinked polyethylene material. However, closure members 28, 30, 32 may be constructed of any plastic, rubber, metal, wood, nylon, phenolic or other composite material. The durable characteristics of members 28, 30 and 32 permit ridge panel 16 to be securely connected to roof 14 with out collapsing ridge closure vent 18 thereby preventing ventilation.

Formed along the length of each member 28, 30 and 32 and laterally therethrough are perforations 36 to allow air to flow therethrough. Perforations 36 are formed through each member 28, 30, 32 and may be offset from or aligned with perforations 36 of adjacent members. As shown in FIG. 2, perforations 36 formed by second closure member 30 are offset from perforations 36 formed by first closure member 28 and from the third closure member 32. This manner of offsetting perforations 36 allows air to flow through closure vent 18, and in combination with mat mesh 34 prevents water, such as, from wind driven rain to pass therethrough.

Mesh mat 34 is disposed between adjacent closure members 28, 30 and 32. Mesh mat 34 spaces each closure member 28, 30, 32 from the others allowing air to flow through perforations 36. In addition, mat 34 aids in preventing water, debris and pests from passing through ridge closure vent 18 to the interior under roof 14.

Mat 34 may be made of a non-woven synthetic fiber such as nylon or polyester. The fibers are opened and blended, then randomly aligned into a web by airflow. The web is then treated with binding agents of water based phenolics and latexes. The treated web is then oven cured to bind the fibers into a relatively rigid mat having a significant porous area between the random fibers.

With reference to FIG. 1 and 2, ridge closure vent 18 includes a plurality of weep holes 38. Weep holes 38 extend upwardly from the bottom surface 40 of closure member 28, which is the exterior most closure member exposed to the exterior of structure 12. Weep holes 38 permit water which may condense within mesh mat 34 to drain.

As further shown in FIG. 1 and 2, an adhesive strip 42 is connected to the bottom surface of closure member 32, which is the interior most closure member, oriented towards the interior of structure 12. Adhesive strip 42 permits roof closure vent 18 to be placed on roof 14 and maintained in place until ridge panel 16 is connected.

Figure 3:
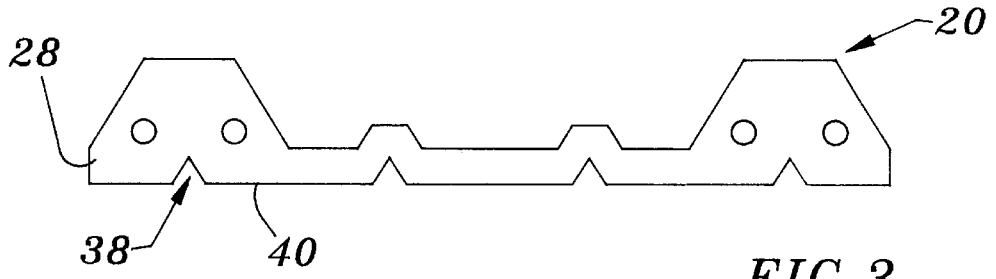
FIG. 3 is a side view of the eave closure vent.

FIG. 3 is a side view of eave closure vent 20. As shown the first closure member 28', which is the exterior most closure member, has weep holes 381 formed along the bottom surface 40' thereof.

As shown in FIGS. 1 though 3, ridge closure vent 18 and eave closure vent 20 are constructed to have a profile to match the contour of roof panels 22. Due to the many different configurations of metal roof panels 22, closure vents 18 and 20 are constructed having various profiles and may be constructed to match individual applications.

Figure 4:
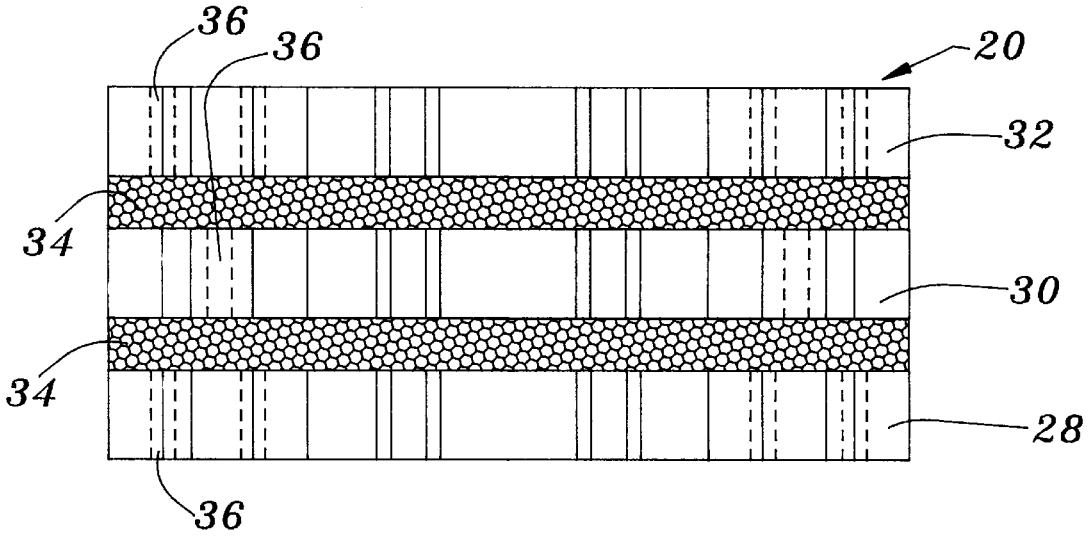
FIG. 4 is a top view of the eave closure vent.

FIG. 4 is a top view of eave closure vent 20. Eave closure vent 18 constructed in the same manner and of the same material as is ridge closure vent 18 (FIG. 2). The difference between closure vent 18 and closure vent 20 is that each has a profile to match the contour of the members between which each is connected.

As shown in FIG. 4, eave closure vent 20 is constructed of a first, second and third closure member 18', 30', 32' and a mesh mat 34'. Each closure member 28', 30', 32' forming perforations 36' laterally therethrough. Preferably, perforations 36' are formed through closure members 28', 30' and 32' so that perforations 36' are offset from the perforations on the adjacent closure member as shown by the hidden lines. Mesh mat 34' is connected between adjacent closure members to act as a spacer and prevent water, debris and pests from penetrating past eave closure vent 20. Closure members 28', 30', 32' are constructed of the same materials as closure members 28, 30 and 32 of ridge closure vent 18 to provide strength and rigidity to eave closure vent 20 to securely attach metal roof 14 without being crushed.

Use of roof closure vent system 10 of the present invention is now described with reference to FIGS. 1–4. In constructing a building 12 which is to have a metal roof 14 a strip of eave closure vent 20 is attached along the length of each eave strut (not shown), then rows of roof panels 22 are connected to the structure to form metal roof 14 leaving a ridge slot 24 along the roof ridge 15 to allow air to escape from beneath roof 14. Ridge closure vents 18 are then connected atop roof panels 22, adjacent ridge slot 24, with adhesive strips 42 or the like. A ridge panel 16 is then fastened to roof 14 atop ridge closure vents 18. With roof closure vent system 10 installed air is vented from interior under roof 14 through perforations 36 formed in closure vent 18 by convection and/or wind suction. Stale vented air is replaced by ambient air provided through eave closure vent 20.

The offset alignment of perforations 36 and 36' in closure vents 18 and 20 aid in preventing water and debris from passing through closure vents 18, 20 and entering the interior under roof 14. Mesh mat 34 and 34' further prevents water penetration, deters pest from entering through perforations 36, 36' and serves as a spacer between closure members 28, 30, 32 and 28', 30' 32'.

It can be seen from the preceding description that a device for providing ventilation from beneath a metal roof which has a ridge closure vent and an eave closure vent, has layered closure vents which provide ventilation without permitting the penetration of water, debris and pest therethrough, that permits ventilation without compromising the secure installation of the roof panels and the ridge panel, and that does not require any additional labor, equipment or accessories from conventional metal roof installations has been provided.

It is noted that the embodiment of the roof closure vent system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A roof closure vent system comprising:

a structure having a sloped metal roof having a ridge slot formed along substantially the length of a roof ridge permifting ventilation from the interior under said roof to the exterior;

a ridge closure vent positioned adjacent each longitudinal side of said ridge slot extending substantially along the length thereof fastened between said roof and a ridge panel;

a first closure member having perforations formed laterally therethrough, said first closure member facing exterior of said structure; and a mesh mat adjacent said first closure member extending substantially the length thereof.

2. The roof closure vent system of claim 1, wherein:

said ridge closure vent includes:

a first closure member having perforations formed laterally therethrough, said first closure member facing exterior of said structure;

a second closure member having perforations formed laterally therethrough; and a mesh mat between said first and said second closure member.

3. The roof closure vent system of claim 1, wherein:

said ridge closure vent includes:

a plurality of closure members, each said closure member having perforations formed laterally therethrough; and a mesh mat between said closure members.

4. The roof closure vent system of claim 1, wherein:

said first closure member forms weep holes extending upwardly from a bottom surface thereof.

5. The roof closure vent system of claim 2, wherein:

at least said exterior closure member forms weep holes extending upwardly from a bottom surface thereof.

6. The roof closure vent system of claim 3, wherein:

at least said closure member facing exterior said structure forms weep holes extending upwardly from a bottom surface thereof.

7. The roof closure vent system of claim 1, further including:

an eave closure vent connected beneath said roof substantially along the length of an eave of said roof, said eave closure vent including a first closure member having perforations formed laterally therethrough, and a mesh mat adjacent said first closure member extending substantially the length thereof.

8. The roof closure vent system of claim 1, further including:

an eave closure vent connected beneath said roof substantially along the length of an eave of said roof, said eave closure vent including a first and second closure member each having perforations formed laterally therethrough, and a mesh mat between said first and said second closure member.

9. The roof closure vent system of claim 1, further including:

an eave closure vent connected beneath said roof substantially along the length of an eave of said roof, said eave closure vent including a plurality of closure members each having perforations formed laterally therethrough, and a mesh mat between said closure members.

10. The roof closure vent system of claim 2, further including:

an eave closure vent connected beneath said roof substantially along the length of an eave of said roof, said eave closure vent including a first closure member having perforations formed laterally therethrough, and a mesh mat adjacent said first closure member extending substantially the length thereof.

11. The roof closure vent system of claim 2, further including:

an eave closure vent connected beneath said roof substantially along the length of an eave of said roof, said eave closure vent including a first and second closure member each having perforations formed laterally therethrough, and a mesh mat between said first and said second closure member.

12. The roof closure vent system of claim 2, further including:

an eave closure vent connected beneath said roof substantially along the length of an eave of said roof, said eave closure vent including a plurality of closure members each having perforations formed laterally therethrough, and a mesh mat between said closure members.

13. The roof closure vent system of claim 3, further including:

an eave closure vent connected beneath said roof substantially along the length of an eave of said roof, said eave closure vent including a first closure member having perforations formed laterally therethrough, and a mesh mat adjacent said first closure member extending substantially the length thereof.

14. The roof closure vent system of claim 3, further including:

an eave closure vent connected beneath said roof substantially along the length of an eave of said roof, said eave closure vent including a first and second closure member each having perforations formed laterally therethrough, and a mesh mat between said first and said second closure member.

15. The roof closure vent system of claim 3, further including:

an eave closure vent connected beneath said roof substantially along the length of an eave of said roof, said eave closure vent including a plurality of closure members each having perforations formed laterally therethrough, and a mesh mat between said closure members.

16. The roof closure vent system of claim 7, wherein:

said exterior closure member of said ridge closure vent forms weep holes extending upwardly from a bottom surface thereof.

17. The roof closure vent system of claim 8, wherein:

at least said exterior closure member of said ridge closure vent forms weep holes extending upwardly from a bottom surface thereof.

18. The roof closure vent system of claim 9, wherein:

at least said exterior closure member of said ridge closure vent forms weep holes extending upwardly from a bottom surface thereof.

19. The roof closure vent system of claim 1, further including:

an adhesive on a bottom surface of at least one said closure member of said ridge closure vent.

20. The roof closure vent system of claim 2, further including:

an adhesive on a bottom surface of at least one said closure member of said ridge closure vent.

21. The roof closure vent system of claim 7, further including:

an adhesive on a bottom surface of at least one said closure member of said ridge closure vent.

22. A roof closure vent system comprising:

an eave closure vent connected beneath a metal roof substantially along the length of an eave of said roof;

wherein said eave closure vent includes:

a first closure member having perforations formed laterally therethrough, and a mesh mat adjacent said first closure member extending substantially the length thereof.

23. The roof closure vent system of claim 22, wherein:

said eave closure vent includes:

a second closure member having perforations formed laterally therethrough, adjacent said mesh mat extending substantially the length thereof.

24. A roof closure vent system comprising:

an eave closure vent connected beneath a metal roof substantially along the length of an eave of said roof;

wherein said eave closure vent includes:

a plurality of closure members each having perforations formed laterally therethrough, and a mesh mat between said closure members.

25. A roof closure vent system comprising:

a structure having a sloped metal roof having a ridge slot formed along substantially the length of a roof ridge permitting ventilation from the interior under said roof to the exterior;

a ridge closure vent positioned adjacent each longitudinal side of said ridge slot extending substantially along the length thereof fastened between said roof and a ridge panel, said ridge closure vent comprising a first closure member having perforations formed laterally therethrough, said first closure member facing exterior of said structure and a second closure member having perforations formed laterally therethrough and offset from said first closure member perforations; and a mesh mat between said first and said second closure member; and an eave closure vent connected beneath said roof substantially along the length of an eave of said roof, said eave closure vent comprising a first closure member having perforations formed laterally therethrough and a second closure member having perforations formed laterally therethrough and offset from said first closure member perforations; and a mesh mat connected between said first and said second closure member.

26. The roof closure vent system of claim 25, further including:

an adhesive on a bottom surface of said second closure member of said ridge closure vent.

27. The roof closure vent system of claim 25, wherein:

at least said exterior closure member of said ridge closure vent forms weep holes extending upwardly from a bottom surface thereof.

28. The roof closure vent system of claim 26, wherein:

at least said exterior closure member of said ridge closure vent forms weep holes extending upwardly from a bottom surface thereof.

* * * * *